US010439276B2

(12) United States Patent
Vendt et al.

(10) Patent No.: US 10,439,276 B2
(45) Date of Patent: Oct. 8, 2019

(54) ANTENNA ASSEMBLY

(71) Applicant: FORD GLOBAL TECHNOLOGIES, LLC, Dearborn, MI (US)

(72) Inventors: Robert Vendt, Macomb, MI (US); Gregory James Grudzinski, Perrysburg, OH (US); George Anthony Bernwanger, Jr., Northville, MI (US); Leo James Lanctot, South Lyon, MI (US); Dave Richard Tengler, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 16 days.

(21) Appl. No.: 15/274,711

(22) Filed: Sep. 23, 2016

(65) Prior Publication Data

US 2018/0090828 A1 Mar. 29, 2018

(51) Int. Cl.

| | |
|---|---|
| ***H01Q 1/32*** | (2006.01) |
| ***H01Q 1/12*** | (2006.01) |
| ***H01Q 1/48*** | (2006.01) |
| ***H01Q 9/26*** | (2006.01) |
| ***H01Q 9/28*** | (2006.01) |
| ***H01Q 9/42*** | (2006.01) |

(52) U.S. Cl.

CPC ..... *H01Q 1/3275* (2013.01); *H01Q 1/1214* (2013.01); *H01Q 1/32* (2013.01); *H01Q 1/48* (2013.01); *H01Q 9/26* (2013.01); *H01Q 9/28* (2013.01); *H01Q 9/42* (2013.01)

(58) Field of Classification Search

CPC ..... B32B 17/10036; B32B 17/10293; B32B 17/10302; B32B 17/10229; H01Q 1/3275; H01Q 1/1271; H01Q 1/325; H01Q 1/48; H01Q 1/1214; B62D 25/06

See application file for complete search history.

(56) References Cited

U.S. PATENT DOCUMENTS 4,821,040 A * 4/1989 Johnson ..... H01Q 1/3275 343/700 MS
5,534,879 A * 7/1996 Braun ..... B32B 17/10036 343/711
8,427,381 B2 4/2013 Labrot et al.
9,166,275 B2 10/2015 Altes et al.
(Continued)

FOREIGN PATENT DOCUMENTS

DE 102004011662 A1 10/2005
DE 102007012486 A1 9/2008
(Continued)

OTHER PUBLICATIONS

Machine Translation of WO 2004086556.*
(Continued)

*Primary Examiner* — Ricardo I Magallanes
(74) *Attorney, Agent, or Firm* — Jason Rogers; Vichit Chea; King & Schickli, PLLC

(57) ABSTRACT

An antenna assembly includes: (a) a ground plane, having a plateau, (b) a roof panel overlying the ground plane around the plateau, (c) a metal foil overlying said plateau and (d) an antenna including a base juxtaposed to the plateau. The antenna assembly is characterized by a through roof panel connection so as to provide a more aesthetically pleasing appearance.

17 Claims, 4 Drawing Sheets

(56) References Cited

U.S. PATENT DOCUMENTS

| | | | | |
|---|---|---|---|---|
| 2006/0101737 | A1* | 5/2006 | Platz | B32B 17/10036 52/204.5 |
| 2010/0059253 | A1* | 3/2010 | Labrot | B32B 17/10036 174/251 |
| 2013/0140847 | A1* | 6/2013 | Altes | H01Q 1/1214 296/152 |
| 2015/0236491 | A1* | 8/2015 | Bureloux | B32B 17/10036 174/650 |

FOREIGN PATENT DOCUMENTS

| | | | | |
|---|---|---|---|---|
| JP | 10242726 | A | 9/1998 | |
| JP | 2006246052 | A | 9/2006 | |
| KR | 20090059979 | A | 6/2009 | |
| WO | WO 2004086556 | A1 * | 10/2004 | H01Q 1/1214 |

OTHER PUBLICATIONS

English Machine Translation of DE102004011662A1.
English Machine Translation of DE102007012486A1.
English Machine Translation of JP2006246052A.
English Machine Translation of JP10242726A.
English Machine Translation of KR20090059979A.

* cited by examiner

ANTENNA ASSEMBLY

TECHNICAL FIELD

This document relates generally to the motor vehicle equipment field and, more particularly, to a motor vehicle antenna characterized by a through roof panel attachment and assembly scheme.

BACKGROUND

A motor vehicle antenna must meet the reception requirements of AM/FM, GPS, satellite radio, cellular regional, cellular global and dedicated short range communication (DSRC—car to car), broadcast/communication technologies. Toward this end, current architecture and design has a small metal plate on a moon roof vehicle as part of the moon roof or a metal mini-roof as part of the body structure across the front or back of the moon roof. See FIG. 1 showing moon roof glass G with metal mini-roof supporting "shark fin" antenna A. Unfortunately, this places limits on the size of the glass panel to accommodate these alternatives. As a rule, body paint areas interrupt the roof glass and these in turn have to be masked and painted in order to make the roof look uniform.

This document relates to a new and improved antenna assembly that not only meets the reception requirements of AM/FM, GPS, satellite radio, cellular regional, cellular global and DSRC but also provides for improved aesthetics and the use of a larger, uninterrupted roof panel of glass or plastic.

SUMMARY

In accordance with the purposes and benefits described herein, an antenna assembly is provided. That antenna assembly comprises a ground plane including a plateau, a metal foil overlying the plateau, a roof panel overlying the ground plane around the plateau and an antenna including a base juxtaposed to the plateau. More specifically, the roof panel includes a mounting opening that extends around the plateau.

That roof panel may include a first layer of glass or plastic and a second layer of glass or plastic. The mounting opening may include a first aperture formed in the first layer and a second aperture formed in the second layer. The first aperture may have a first perimeter while the second aperture may have a second perimeter wherein the second perimeter is fully contained within the first perimeter. At least one RF coupling standoff or a connection lead may be provided between the base and the second layer within the first perimeter.

A first water seal may be provided between the base and the first layer. In addition, a second water seal may be provided between the base and the plateau. Still further a dust seal may be provided between the base and the first layer.

In at least one of the many possible embodiments, the first layer and the second glass may be tempered glass. An adhesive layer may be provided between the first layer and the second layer. In addition, the metal foil may be provided between the first layer and the second layer. The ground plane and the metal foil function together to significantly improve the reception of the antenna.

In at least one of the many possible embodiments, an IR coating may be provided between the first layer and the second layer. Further, in at least one of the many possible embodiments instead of tempered glass, the second layer may be an alkali-aluminosilicate sheet glass.

In the following description, there are shown and described several preferred embodiments of the antenna assembly. As it should be realized, the antenna assembly is capable of other, different embodiments and its several details are capable of modification in various, obvious aspects all without departing from the antenna assembly as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the antenna assembly and together with the description serves to explain certain principles thereof. In the drawing figures.

Reference will now be made in detail to the present preferred embodiments of the antenna assembly, an example of which is illustrated in the accompanying drawing figures.

DETAILED DESCRIPTION

Figure 1:
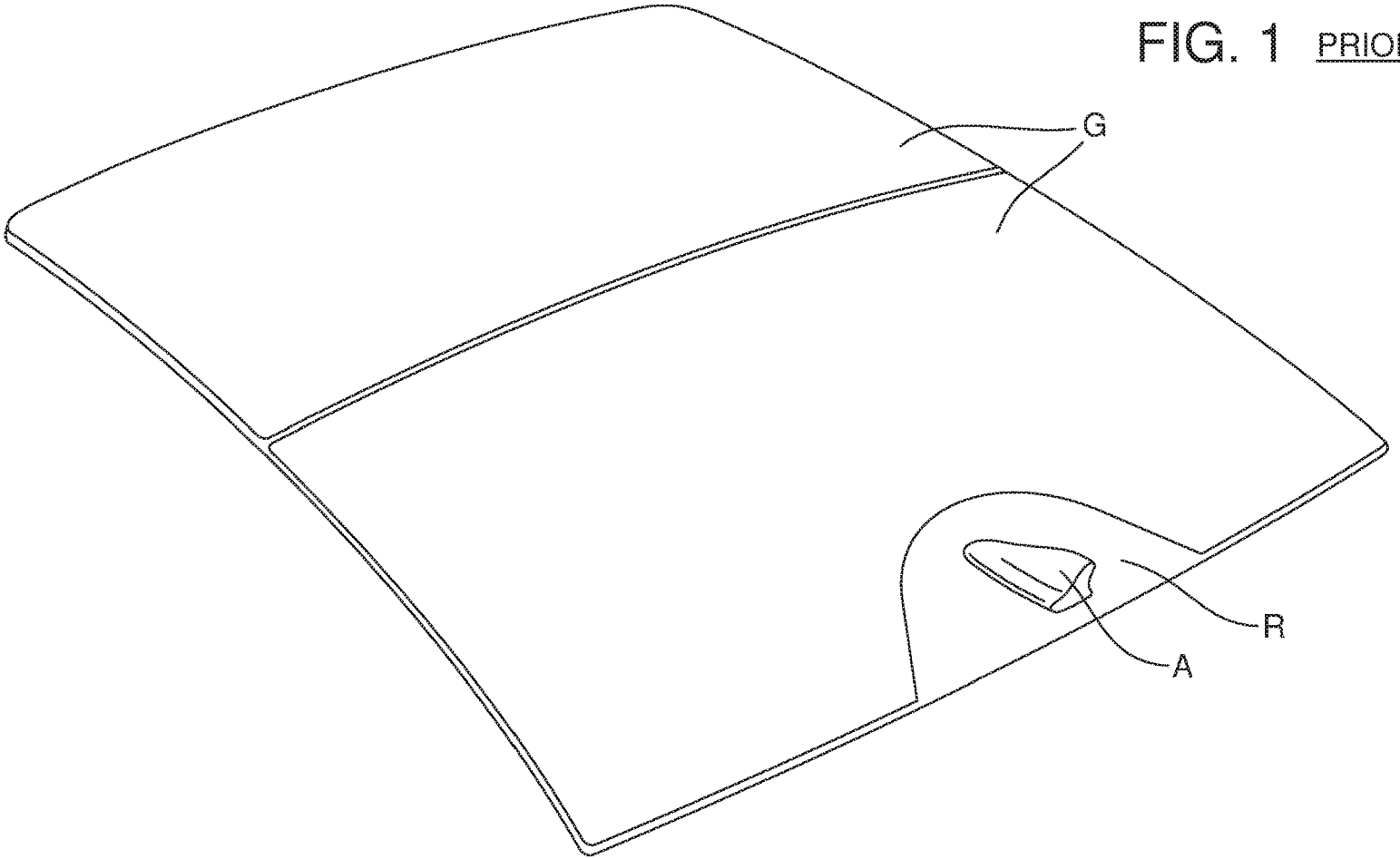
FIG. 1 PRIOR ART
FIG. 1 is a perspective view of a prior art antenna assembly wherein the "shark fin" antenna is mounted on an antenna plate or metal mini-roof which interrupts the roof glass.
Figure 2:
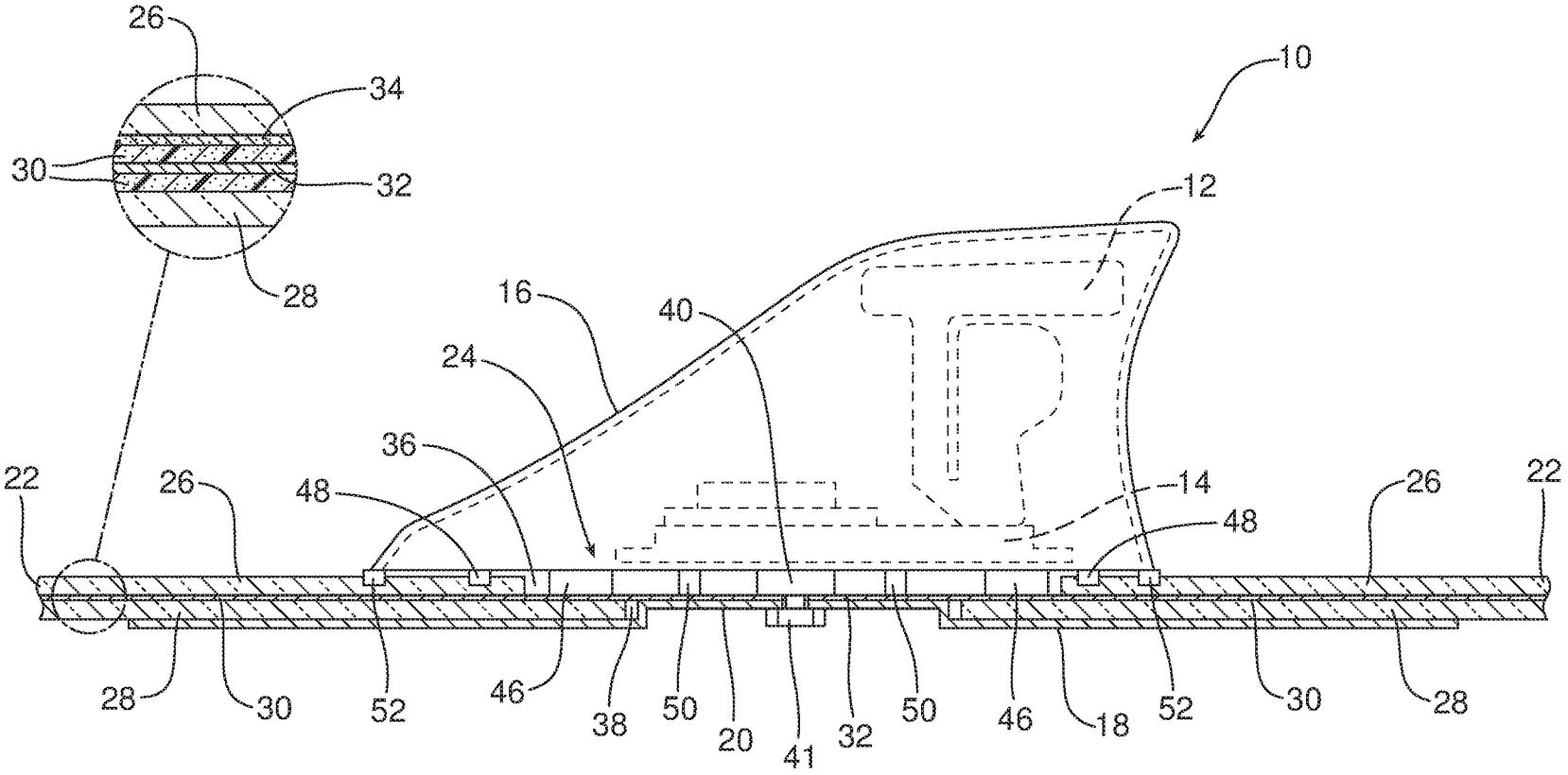
FIG. 2 is a schematic cross-sectional view illustrating the new and improved antenna assembly which is mounted through the roof glass.

Reference is now made to FIG. 2 illustrating the new and improved antenna assembly 10. The antenna assembly 10 includes an antenna 12 carried on a base 14 and housed within a shark fin shaped body 16.

The antenna assembly 10 also includes a ground plane 18 having a raised area or plateau 20. The ground plane 18, including the plateau 20, is made from an appropriate metal in order to improve antenna reception. The ground plane 18 may be about 300 mm in diameter (minimum) directly underneath the antenna 12. Typically, the plateau 20 has a height of between about 1.0 and 4.0 mm.

A roof panel 22 overlies the ground plane 18. The roof panel 22 includes an antenna mounting opening 24 that extends around the plateau 20. More specifically, the roof panel 22 includes a first layer 26 and a second layer 28. An adhesive layer 30 of polyvinyl butyral (PVB) or other appropriate material is provided between the first layer 26 and the second layer 28. In addition, a metal foil 32 may be provided in the adhesive layer 30 between the first layer 26 and the second layer 28. The metal foil 32 extends over the top of the plateau 20 and functions in conjunction with the ground plane 18 to improve the reception of the antenna 12. Toward this end, the ground plane 18 and the metal foil 32 are both grounded to the motor vehicle body via RF ground strap (not shown).

In some embodiments an IR coating 34 may also be provided between the first layer 26 and the second layer 28.

In the illustrated embodiment, that IR coating 34 is provided on the bottom face of the first layer 26.

In many of the possible embodiments, the first layer 26 is formed from a tempered glass. The second layer 28 may be formed from a tempered glass as well. Where the first layer 26 and the second layer 28 are both formed from a tempered glass, the formulation of the tempered glass does not necessarily need to be identical and the thicknesses of the first layer 26 and the second layer 28 also do not need to be identical.

In other possible embodiments, the second layer 28 is formed from an alkali-aluminosilicate sheet glass in order to provide additional strength to the roof panel 22. In one particularly useful embodiment, the first layer 26 is a tempered glass with a thickness of about 1.6 mm and the second, underlying layer 28 is an aluminosilicate sheet glass with a thickness of about 0.7 mm. Here it should be appreciated that this particular embodiment detailed above should be considered exemplary and not limiting in scope. In fact, the first layer 26 and the second layer 28 may be made from various glass or plastic materials including, but not necessarily limited to tempered glass, semi-tempered or heat strengthened glass, annealed glass, polycarbonate or other appropriate transparent, translucent or opaque plastic. Further, in some embodiments, the roof panel 22 may be a single layer.

As further illustrated in FIG. 2, the mounting opening 24 provided in the roof panel 22 may comprise a first aperture 36 in the first layer 26 and a second aperture 38 in the second layer 28. That first aperture 36 may have a first perimeter while the second aperture 38 has a second perimeter wherein the second perimeter is fully contained within the first perimeter. The first aperture 36 and the second aperture 38 may be of any appropriate shape. In some embodiments, the first aperture 36 and second aperture 38 are cut by a series of overlapping drill holes in a process known as the Olympic circle concept.

When the antenna assembly 10 is fully assembled, the base 14 supporting the antenna 12 is connected via the antenna foot 46 and one or more bolts 41 juxtaposed to the plateau 20 of the ground plane 18. In one possible embodiment, the base 14 includes two threated studs that extend through two cooperating apertures in the plateau 20 and one or more captured bolts secure the connection 40. Here it should be appreciated that the connection 40 is schematically illustrated in FIG. 2.

Figure 4:
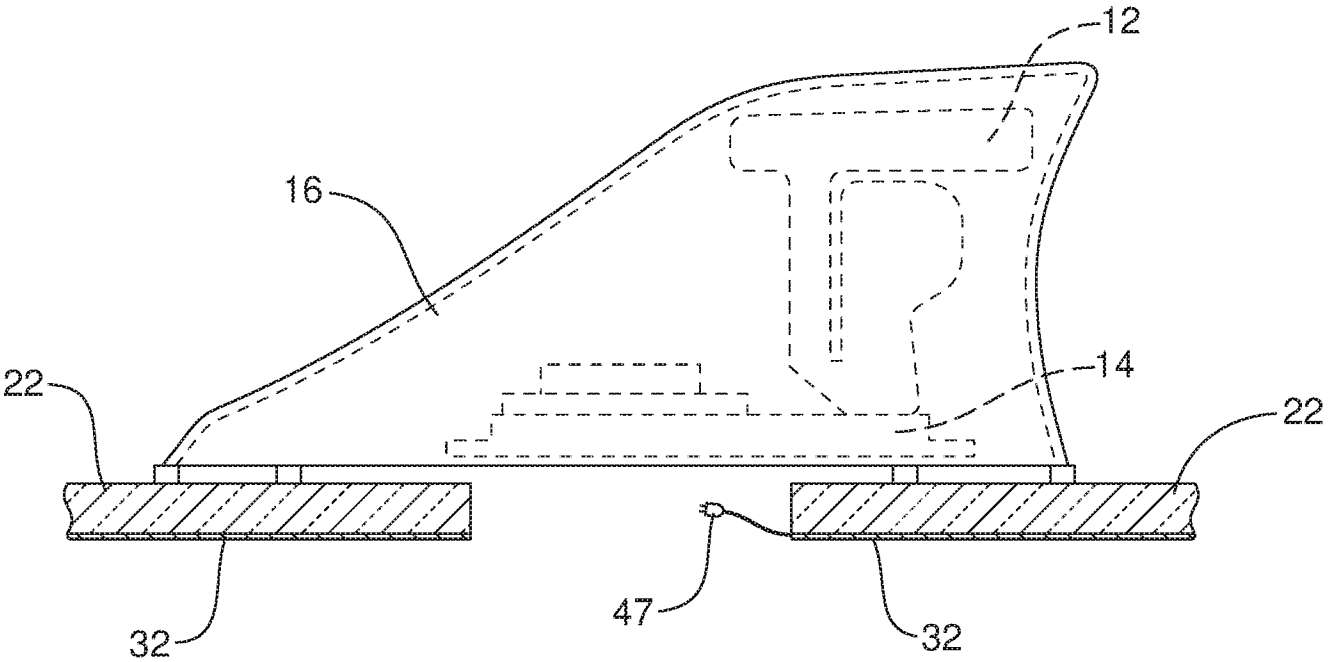
FIG. 4 is a schematic view highlighting an alternative embodiment including a connection lead instead of a RF coupling standoff.

As further illustrated in FIG. 2, at least one RF coupling standoff 46 is provided between the base 14 and the second layer 28 within the first perimeter of the first aperture 36. In the FIG. 2 embodiment, the RF coupling standoff 46 touches the metal foil 32 to make the connection for best reception. In an alternative embodiment, illustrated in FIG. 4, a connector lead 47 is provided to make the connection with the metal foil 32 underlying the single layer roof panel 22 in place of the RF coupling standoff 46.

Referring back to FIG. 2, a first water seal 48 is provided between the base 14 and the first layer 26. A second water seal 50 is provided between the base 14 and the plateau 20 of the ground plane 18. In addition, a dust seal 52 is provided between the base 14 and the first layer 26. Preferably, the first water seal 48, the second water seal 50 and the dust seal 52 are all continuous, uninterrupted bodies made from an appropriate seal material.

Figure 3:
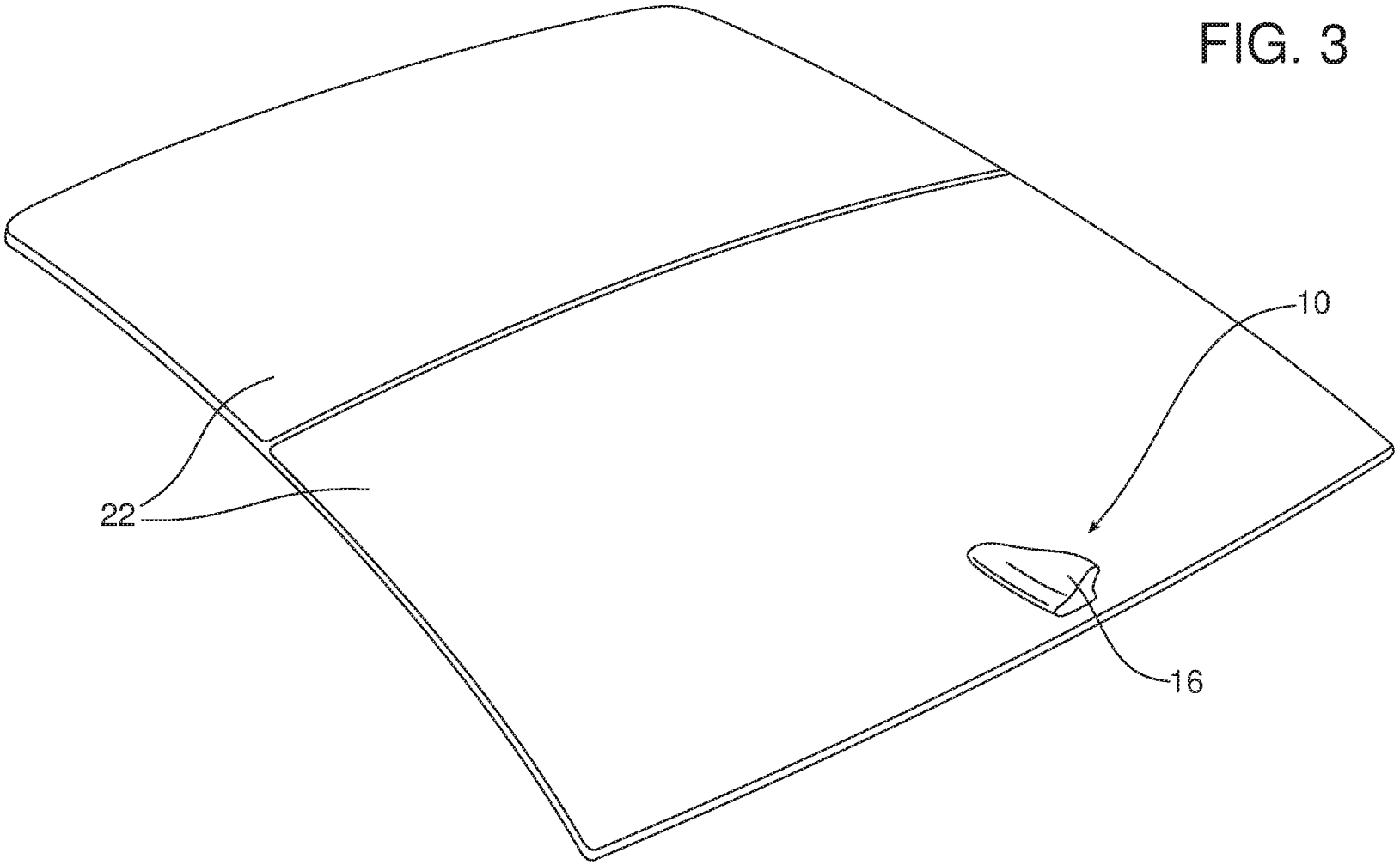
FIG. 3 is a perspective view of the new and improved antenna assembly illustrating how the shark fin antenna is mounted onto the roof glass thereby providing a more aesthetically pleasing appearance.

As illustrated in FIG. 3, the antenna assembly 10 provides the appearance of an antenna 12 resting on an uninterrupted roof panel 22. The first layer 26 including, particularly, the inner face of the first layer 26 may be tinted or painted to conceal the underlying metal foil 32 and ground plane 18 that are provided to enhance the reception of the antenna 12. Thus, the roof incorporates what appears to be an uninterrupted, continuous face which is more aesthetically pleasing. A headliner (not shown) may be provided under the ground plane 18 in order to conceal the ground plane 18 from view at the interior of the motor vehicle.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. An antenna assembly, comprising:

a ground plane including a plateau;

a metal foil overlying a portion of said plateau;

a roof panel overlying said ground plane and including a mounting opening configured to extend around said plateau whereby at least a roof panel-facing surface of said plateau does not overlap said roof panel; and an antenna including a base juxtaposed to said plateau;

said roof panel including a first layer made from a first group of materials consisting of glass or plastic, and a second layer made from a second group of materials consisting of glass or plastic;

wherein said mounting opening includes a first aperture having a first perimeter formed in said first layer and a second aperture having a second perimeter formed in said second layer;

further wherein said second perimeter is fully contained within said first perimeter and also the first perimeter is superimposed above the second perimeter.

2. The antenna assembly of claim 1, including at least one RF coupling standoff or a connection lead between said base and said second layer within said first perimeter.

3. The antenna assembly of claim 2, including a first water seal between said base and said first layer.

4. The antenna assembly of claim 3, including a second water seal between said base and said plateau.

5. The antenna assembly of claim 4, including a dust seal between said base and said first layer.

6. The antenna assembly of claim 5, wherein said first layer is tempered glass.

7. The antenna assembly of claim 6, wherein said second layer is tempered glass.

8. The antenna assembly of claim 7, including an adhesive layer between said first layer and said second layer.

9. The antenna assembly of claim 8, wherein said metal foil is provided between said first layer and said second layer.

10. The antenna assembly of claim 7, including an IR coating between said first layer and said second layer.

11. The antenna assembly of claim 6, wherein said second layer is alkali-aluminosilicate sheet glass.

12. The antenna assembly of claim 11, including an adhesive layer between said first layer and said second layer.

13. The antenna assembly of claim 12, wherein said metal foil is provided between said first layer and said second layer.

14. The antenna assembly of claim 11, including an IR coating between said first layer and said second layer.

15. The antenna assembly of claim 1, wherein said first layer and said second layer are tempered glass.

16. The antenna assembly of claim 1, wherein said first layer is tempered glass and said second layer is alkali-aluminosilicate sheet glass.

17. An antenna assembly, comprising:

a ground plane including a plateau;

a metal foil overlying a portion of said ground plane;

a roof panel comprising a mounting opening configured to extend around said plateau whereby at least a roof panel-facing surface of said plateau does not overlap said roof panel; and an antenna including a base juxtaposed to said plateau;

wherein the base interfaces with at least the metal foil.

* * * * *